US005735087A

United States Patent [19]

Olden

[11] Patent Number: 5,735,087

[45] Date of Patent: Apr. 7, 1998

[54] TRUSS WITH INTEGRAL HOLD DOWN STRAP

[75] Inventor: Marc Olden, Pacific, Mo.

[73] Assignee: MiTek Holdings, Inc., Wilmington, Del.

[21] Appl. No.: 684,489

[22] Filed: Jul. 19, 1996

[51] Int. Cl.[6] ..... E04B 7/04

[52] U.S. Cl. ..... 52/92.2; 52/712; 52/715; 52/92.1; 52/93.1; 52/693

[58] Field of Search ..... 52/712, 715, 693, 52/696, 269, DIG. 6, 92.2, 92.1, 93.1

[56] References Cited

U.S. PATENT DOCUMENTS

| | | | |
|---|---|---|---|
| 2,078,968 | 5/1937 | Patterson | 189/1 |
| 2,143,420 | 1/1939 | Livermore | 72/105 |
| 3,293,808 | 12/1966 | Duncan | 52/92 |
| 3,425,720 | 2/1969 | Spane | 287/20.92 |
| 3,861,094 | 1/1975 | Jureit et al. | 52/86 |
| 4,411,547 | 10/1983 | Johnson | 403/205 |
| 4,455,805 | 6/1984 | Rionda et al. | 52/DIG. 6 X |
| 4,555,887 | 12/1985 | Rionda et al. | 52/712 |
| 4,561,230 | 12/1985 | Rionda et al. | 52/DIG. 6 X |
| 4,713,923 | 12/1987 | Sielaff et al. | 52/713 |
| 4,825,621 | 5/1989 | Jensen | 52/702 |
| 4,976,085 | 12/1990 | Krueger | 52/715 |
| 5,006,006 | 4/1991 | Lehtonen | 52/712 X |
| 5,257,483 | 11/1993 | Netek | 52/23 |
| 5,303,520 | 4/1994 | Gozdziak | 52/92.2 |
| 5,311,708 | 5/1994 | Frye | 52/90.1 |
| 5,410,854 | 5/1995 | Kimmell et al. | 52/712 |
| 5,497,591 | 3/1996 | Nelson | 52/481.1 |
| 5,561,949 | 10/1996 | Knoth | 52/92.2 |

FOREIGN PATENT DOCUMENTS

| | | |
|---|---|---|
| 1458233 | 10/1966 | France . |
| 166277 | 3/1934 | Sweden . |
| 2 069 024 | 8/1981 | United Kingdom . |
| 2 138 464 | 10/1984 | United Kingdom . |
| 2 174 122 | 10/1986 | United Kingdom . |
| 2 185 275 | 7/1987 | United Kingdom . |
| 2 191 520 | 12/1987 | United Kingdom . |
| 2 287 488 | 9/1995 | United Kingdom . |

OTHER PUBLICATIONS

United Steel Products Company catalog entitled "Kant-Sag® Construction Hardware," pp. 2 and 34, 1986.

The Panel Clip Company advertisement entitled "Structural Framing Connectors," p. 27, 1987.

Simpson Strong-Tie Company, Inc. Technical Bulletin No. THW991 entitled "Connectors For High Wind Applications," p. 6, 1991.

*Primary Examiner*—Carl D. Friedman

*Assistant Examiner*—Yvonne Horton-Richardson

*Attorney, Agent, or Firm*—Senniger, Powers, Leavitt & Roedel

[57] ABSTRACT

A truss having an integral hold down strap can be secured to the wall of a structure. The hold down strap is held between two truss elements, such as a web member intersecting with a lower chord of the truss. The hold down strap is secured to the truss by a nailing plate which can be one of the same nailing plates used to connect other elements of the truss together. The nailing plate teeth penetrate the hold down strap and one of the truss elements to secure the strap to the truss for shipment to a construction site. The hold down strap extends from between the truss elements down into engagement with the wall on which the truss rests where it may be secured to the wall.

22 Claims, 5 Drawing Sheets

TRUSS WITH INTEGRAL HOLD DOWN STRAP

BACKGROUND OF THE INVENTION

This invention relates generally to trusses and more particularly to a truss having a hold down strap which is integral with the truss.

Structures which are occasionally subject to sustained high winds, such as structures located in regions subject to hurricanes, preferably have substantial connections between components of the structure to increase the strength of the structure and prevent damage in high winds. Building codes in these regions require that there be additional connections between trusses in the roof, joists in the floor and the walls to anchor the roof and floor. For instance, it may be required to anchor each end of a truss or floor joist to the adjacent wall with a hold down strap.

It is well known to provide flexible metal straps for the purpose of connecting the roof truss (or floor joist) to a stud in an adjacent wall. An example of such a strap is shown in U.S. Pat. No. 3,861,094 (Jureit et al.). The Jureit et al. strap is an elongate piece of sheet metal formed at either end with teeth projecting outwardly from the sheet metal. Small, spaced apart sections are erupted from the sheet metal as by punching to define the teeth. The ends of the strap are driven into the truss and into a stud in the wall, respectively, to secure one to the other.

Toothed hold down straps can be hammered into the truss (or joist) and adjacent wall by laborers at the construction site. However, this is a time consuming process and often requires the laborers to get into precarious positions high up on the structure near the edge of the roof to secure the hold down straps to the wall. Moreover, the hold down straps must be stored by the laborers and then located when needed for securing the truss. It is known to secure one end of a toothed strap to the truss at a plant where the truss is assembled so that the strap is integrated with the truss prior to erecting the truss on the wall of the structure. The end of the toothed hold down strap can be pressed into the truss by the same press used to drive other nailing plates into adjoining wooden elements forming the truss. At the construction site, the laborer need only secure the other end of the strap to an adjacent stud.

The sheet metal must be sufficiently strong so that the teeth formed can be driven into the wooden elements of the truss or joist and the wall. There must be enough thickness in the sheet material so that teeth punched from the sheet material will not simply bend over rather than penetrating the wood of the truss components when pressed against them. Sheet material having this thickness (e.g., 22 gauge sheet metal) is thicker than needed to adequately secure the truss to the wall. Thus, the cost of the straps is high because the sheet metal must be quite heavy so that teeth formed are of sufficient strength. Further, the formation of the teeth in the hold down straps is an additional step in the construction process, whether the hold down straps are secured to the truss at the construction site or at the assembly plant. The tooth formation step, which is in addition to the step of stamping out the hold down straps from a web of sheet metal, also adds to the cost of the truss.

SUMMARY OF THE INVENTION

Among the several objects and features of the present invention may be noted the provision of a structural component such as a truss having an integral hold down strap; the provision of such a structural component which minimizes the material in the hold down strap; the provision of such a structural component which connects the hold down strap with the same connector used to join together other elements making up the structural component; the provision of such a structural component in which the hold down strap is accurately located and firmly secured; and the provision of such a structural component which is economical to manufacture.

Further among the several objects and features of the present invention may be noted the provision of a method for assembling a truss in which a hold down strap is integrated into the truss; the provision of such a method which facilitates accurate location of the hold down strap on the truss time after time; and the provision of such a method which can be carried out rapidly.

Still further among the several objects and features of the present invention may be noted the provision of a hold down strap for use in securing a truss to a wall of a structure; the provision of such a hold down strap which is readily integrated with the truss during the assembly of the truss; the provision of such a hold down strap which may be secured by the same nailing plates which connect elements of the truss together; and the provision of such a hold down strap which is economical to manufacture.

Generally, a structural component such as a truss for use with other structural components to form a structure comprises a first member including a first surface and a second surface non-coplanar with the first surface, and a second member of thin, flat sheet material engaging the first surface of said first member in face-to-face relation. A nailing plate having teeth penetrating the second surface of said first member and teeth penetrating the second member secures the second member to the first member.

In another aspect of the present invention, a hold down strap is disclosed for securing a truss formed by elongate truss elements to a wall of a structure. The hold down strap generally comprises an elongate piece of sheet metal which is smooth, flat and free of teeth formed therein. The hold down strap includes a first portion and a second portion, the first portion having a central region and a pair of flanges on either side of the central region. The central region has a transverse dimension approximately equal to a transverse dimension of at least one of the truss elements. The flanges are foldable along longitudinal edges of the central portion to configure the first portion of the hold down strap to have a generally U-shaped cross section. As thus folded, the first portion is constructed to receive a portion of the truss element therein with the folded flanges engageable with the one truss element and constructed for penetration by teeth of a nailing plate to secure the hold down strap to the truss element. The second portion of the hold down strap is sized to extend down from the truss into engagement with a wall of the structure and to receive a connector therethrough for securing the truss to the wall.

In yet another aspect of the present invention, a method for forming a truss with integral hold down straps for connection to a wall of a structure. The method generally comprises the steps of placing elongate truss elements in a truss assembly jig and positioning thin, flat hold down straps having longitudinal edges between converging truss elements at the ends of the truss. Nailing plates are placed on at least one of the truss elements generally at opposite ends of the truss. Each nailing plate has teeth in registration with at least one of the truss elements at the corresponding end of the truss and teeth in registration with the hold down strap. Driving the nailing plates into the truss so that teeth from each nailing plate penetrate the hold down strap and penetrate the one truss element connects the hold down strap to the truss.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
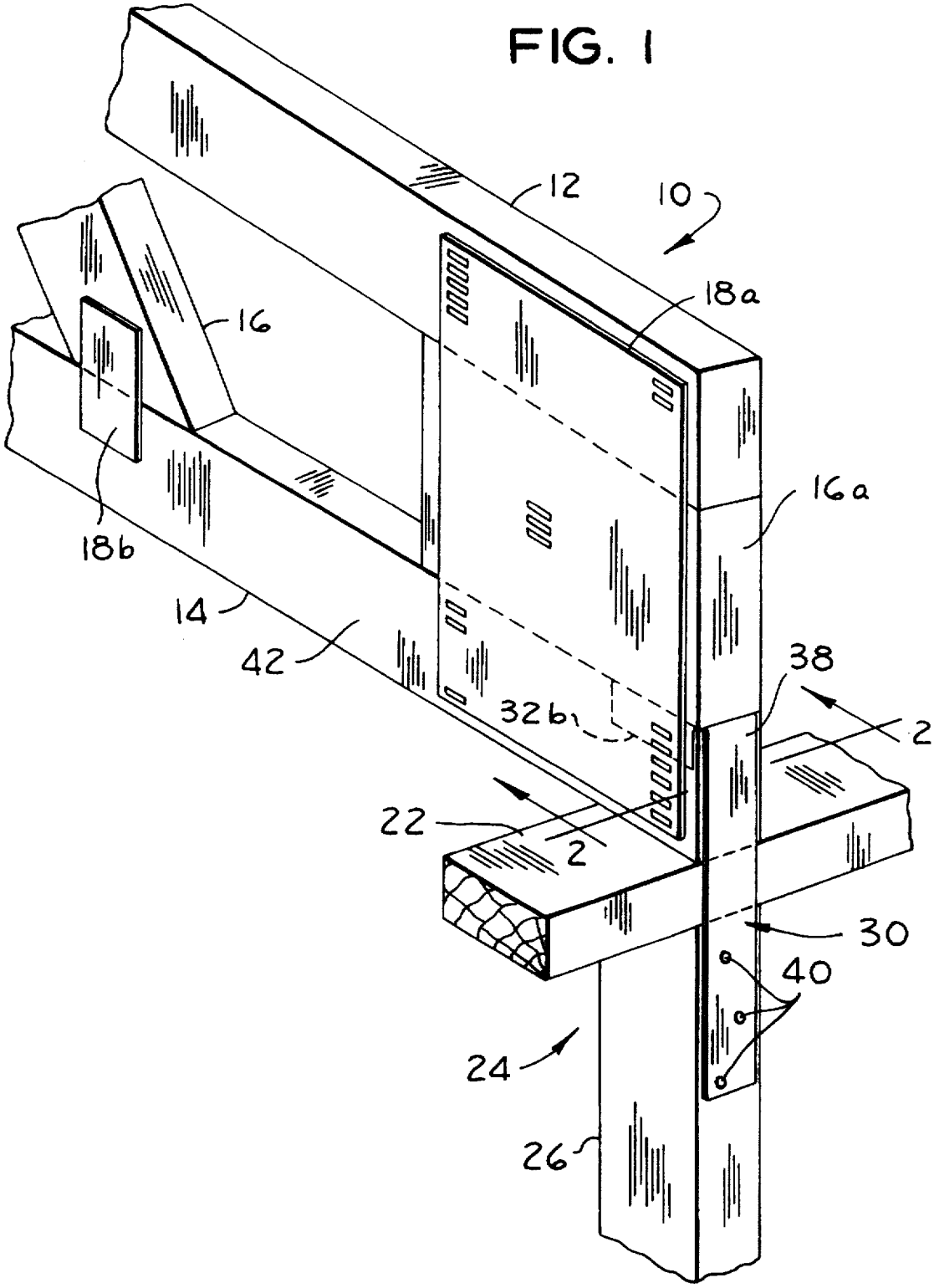
FIG. 1 is a fragmentary perspective showing connection of a truss having an integral hold down strap to the stud in a wall of a structure.

Referring now to the drawings and in particular to FIG. 1, a truss constructed according to the principles of the present invention is generally designated at 10. The truss 10 has an upper chord 12 and a lower chord 14 which generally converges with the upper chord 12 toward a heel of the truss. Web members 16 (including polygonal block 16*a* located at the heel of truss 10) extend between the upper and chords 12, 14 providing the necessary additional strength and rigidity. The upper and lower chords 12, 14 and web members 16 are connected to each other where they intersect by nailing plates 18 (including nailing plates 18*a* and 18*b* illustrated in FIG. 1) in the manner well known to those of ordinary skill in the art. Each chord 12, 14 and web member 16 may be formed from one or more pieces of wood or other suitable material. The truss 10 as described thus far is of conventional construction. The present invention has application to all types of trusses, including without limitation flat trusses, as well as to other structural components, such as floor joists.

Figure 2:
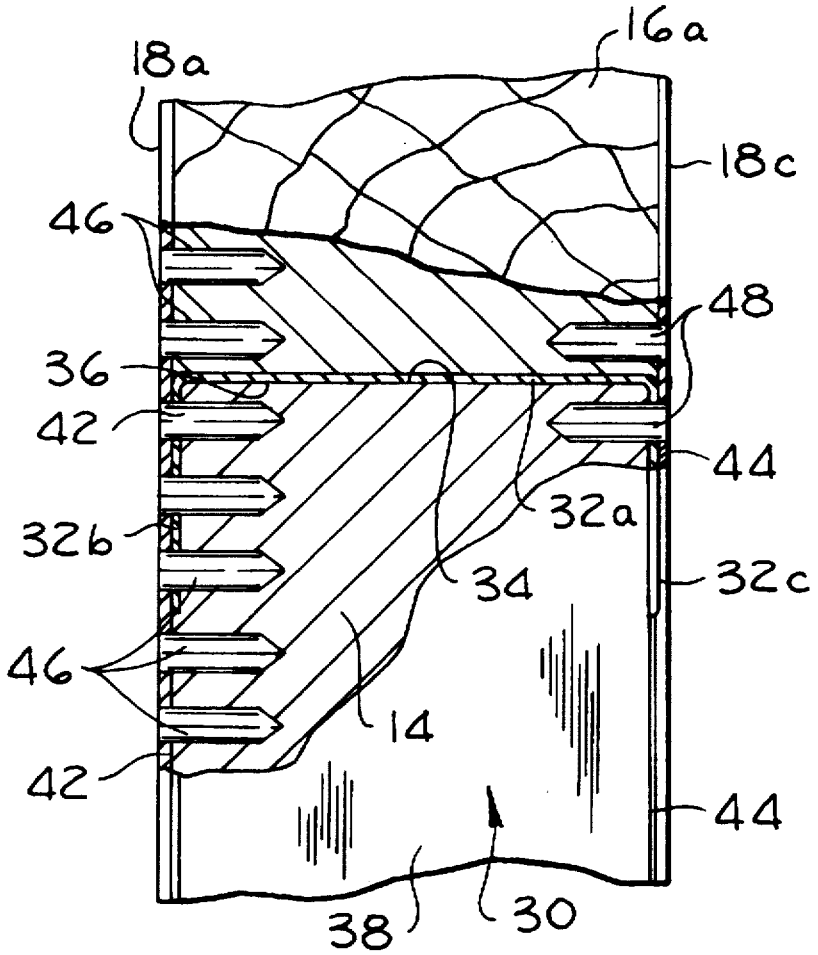
FIG. 2 is an enlarged fragmentary right end elevation of the truss of FIG. 1 as seen from the vantage indicated by line 2—2 of FIG. 1 and illustrating the penetration of teeth from a nailing plate through the hold down strap and into the truss.
Figure 3:
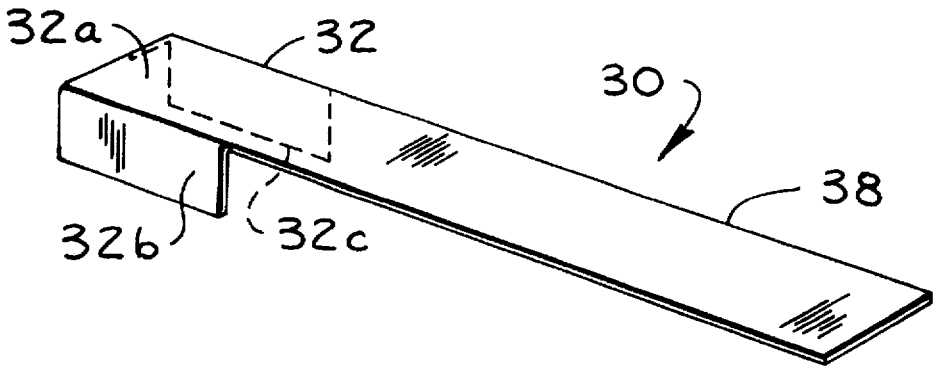
FIG. 3 is an enlarged perspective view of a hold down strap of a first embodiment.

The lower chord 14 at the heel of the truss 10 illustrated in FIG. 1 rests on the top wall plate 22 of a wall generally indicated at 24. The top wall plate 22 is supported by studs 26 (only one is shown) in a conventional manner. Referring to FIGS. 1–3, a hold down strap of a first embodiment of the present invention (generally indicated by reference numeral 30) is an elongate piece of sheet metal including a first portion 32 sandwiched between an upper ("first") surface 34 of the lower chord 14 and a lower ("first") surface 36 of the block 16*a*. In the illustrated embodiment, the lower chord 14 constitutes a "first member", the hold down strap 30 constitutes a "second member" and the block 16*a* constitutes a "third member". It is to be understood that the hold down strap may be located elsewhere, including without limitation on top or bottom of the upper chord 12, on the bottom of the lower chord 14, between the upper and lower chords or between the upper chord and a web member 16, without departing from the scope of the present invention. A second portion 38 of the hold down strap 30 extends from between the lower chord 14 and block 16*a*, and is bent down to extend along the lower chord and top wall plate 22 to the stud 26 to which it is secured such as by nails 40.

As shown in FIG. 3, the first portion 32 of the hold down strap 30 has a central region 32*a* and a pair of flanges 32*b*, 32*c* located on opposite longitudinal edges of the central region. The flanges 32*b*, 32*c* are bent downwardly so that the first portion 32 of the hold down strap 30 has a generally (inverted) U-shaped cross section. The transverse dimension of the central region 32*a* is approximately equal to the transverse dimension of the second portion 38 of the hold down strap 30, and to the transverse dimension of the upper surface 34 of the lower chord 14 (FIG. 2). The upper surface 34 of the lower chord is received between the flanges 32*b*, 32*c* so that the central region 32*a* of the first portion 32 of the hold down strap 30 lies in face-to-face engagement with the upper surface 34. The flanges 32*b*, 32*c* lie in generally face-to-face engagement with corresponding (second and third) side surfaces (designated 42 and 44, respectively) of the lower chord 14 which are generally perpendicular to the upper surface 34.

Figure 4:
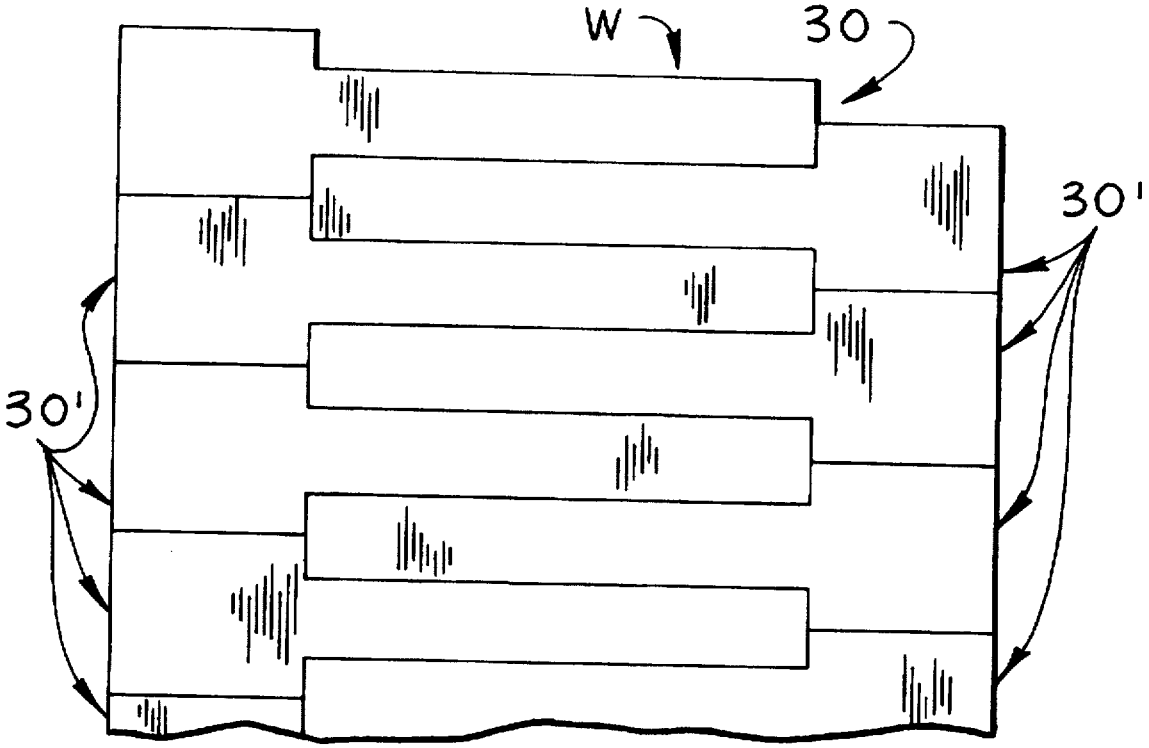
FIG. 4 is a plan view of hold down straps stamped from a sheet metal web prior to separation.

As shown in FIG. 4, the hold down strap 30 is preferably made by stamping as one piece from a web W of sheet metal along with other hold down straps (generally designated at 30'). The flanges 32*b*, 32*c* of the hold down strap 30 are sized so that all of the material in the web of sheet metal is used. In the preferred embodiment, the hold down straps are formed from 26 gauge sheet metal. Sheet metal of other thicknesses may be used so long as the metal is sufficiently thick to meet building code requirements and sufficiently thin to permit penetration by standard nailing plates, which are at present typically formed from 20 gauge sheet metal. The sheet material of the hold down strap 30 is smooth, flat and free of teeth formed therein both before and after formation of the hold down strap. As stamped from the web, the hold down strap 30 of the first preferred embodiment is 12.5" long, 1.5" wide along the second portion 38 and 3" wide at the flanges 32*b*, 32*c* prior to their being folded down. When the flanges 32*b*, 32*c* are folded down, the central region 32*a* has a transverse dimension of about 1.5" which will receive the narrower side of a 2×4 or a 2×10. Of course, the dimensions of the hold down strap 30 may be other than described without departing from the scope of the present invention.

Referring now to FIGS. 1 and 2, the nailing plate 18*a* connects the lower chord 14, block 16*a* and upper chord 12 together at the heel of the truss 10. As shown in FIG. 2, teeth 46 of the nailing plate 18*a* penetrate the flange 32*b* of the hold down strap 30 and the second surface 42 of the lower chord 14 into the wood of the lower chord. The penetration of the flange 32*b* fixedly secures the hold down strap 30 to the truss 10 at the heel. The teeth 48 extend parallel to the plane of the portion of the first portion 32 of the hold down strap 30 lying between the block 16*a* and lower chord 14. Another nailing plate 18*c*, substantially identical to nailing plate 18*a*, on the opposite side of the truss has teeth 48 penetrating the opposite flange 32*c* and the lower chord 14. The hold down strap 30 is preferably free of any other connection to the truss except by the nailing plates 18*a*, 18*c*. When the second portion 38 of the hold down strap 30 is secured to the stud 26, it functions to hold the heel of the truss 10 down on the wall 24. A substantially identical hold down strap (not shown) holds down the opposite end of the truss 10 so that the entire truss is secured to the structure by the hold down straps 30. Hold down straps may be used intermediate the ends of the truss 10 to connect the truss 10 to interior walls without departing from the scope of the present invention.

Figure 5:
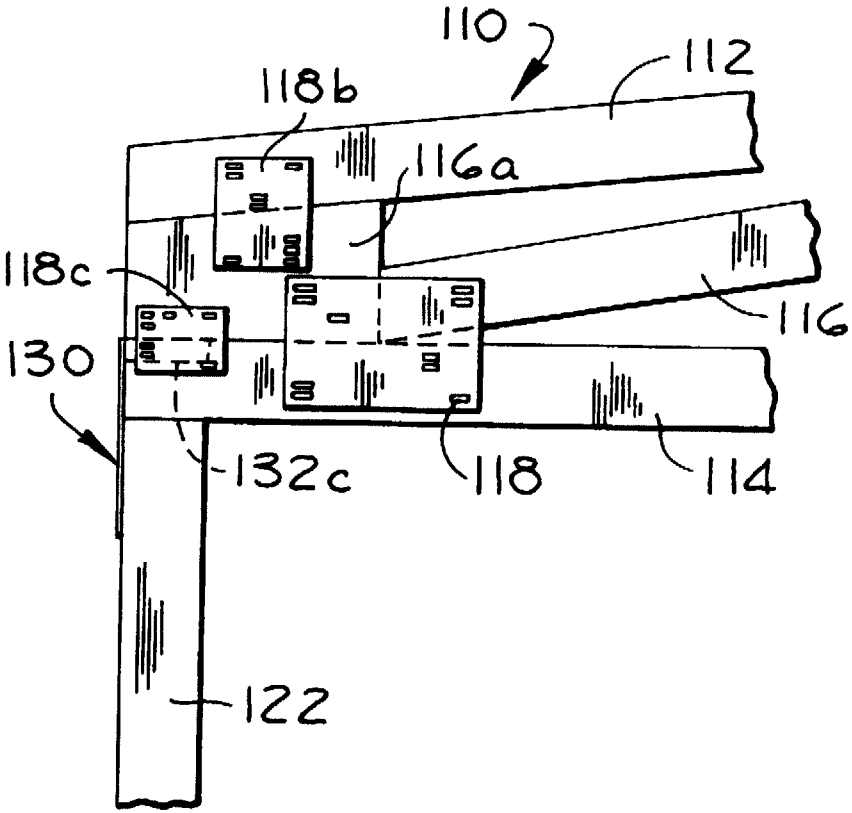
FIG. 5 is a fragmentary elevation showing an alternative configuration of a truss having an integral hold down strap.

A truss 110 having a slightly modified heel configuration is shown in FIG. 5. The elements of the different trusses shown in FIGS. 5–8 will have the same reference numbers as for corresponding elements of the truss 10 shown in FIGS. 1–4, but with the addition of the prefix "1", "2", "3" or "4". In this case, one nailing plate 118*a* is used to secure a block 116*a* to a lower chord 114 of the truss 110 and to a web member 116 extending from the block. Another nailing plate 118*b* secured the block 116*a* to an upper chord 112. In the modified truss heel, the hold down strap 130 has its own nailing plate 118*c*, provided solely for the purpose of securing the hold down strap to the truss 110. The nailing plate 118*c* penetrates the flange 132*c* of the hold down strap 130 shown in FIG. 5 the same way as the nailing plate 18*a* penetrates the flange 32*c* of the hold down strap 30 shown in FIG. 2.

Figure 6:
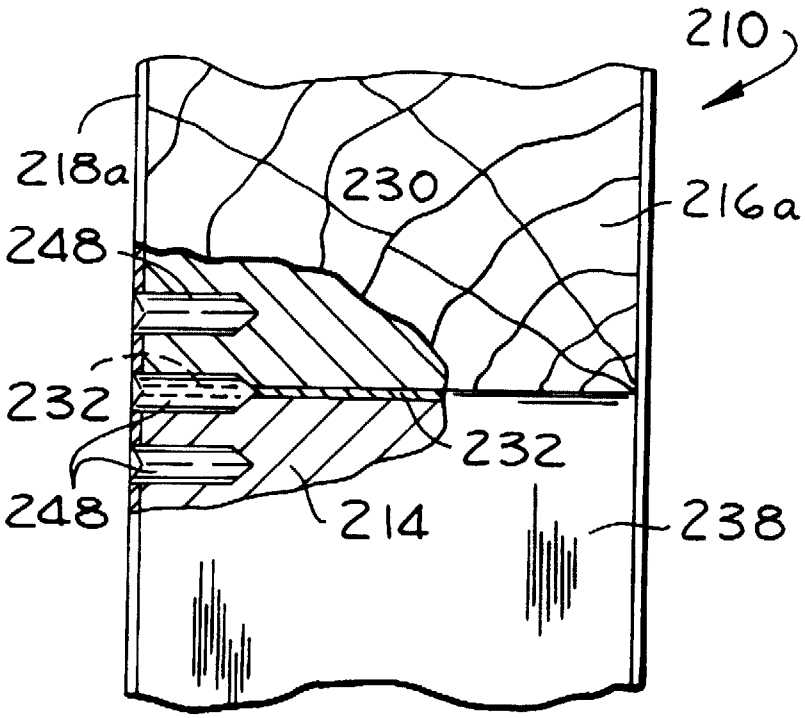
FIG. 6 is a perspective similar to FIG. 2 but showing a hold down strap of a second embodiment.

A second embodiment of the hold down strap, indicated generally at 230 in FIG. 6, is identical to the hold down strap 30 of the first embodiment, except that it has no flanges. FIG. 6 is a view substantially the same as FIG. 2 except that the hold down strap 230 of the second embodiment is illustrated and only one nailing plate 218*a* is shown. A first portion 232 of the hold down strap 230 is sandwiched between a lower chord 214 and a web member 216*a*. Teeth 248 of the nailing plate 218*a* penetrate the first portion 232 of the hold down strap 230 edge on to secure the hold down strap to the truss 210. The teeth 248 cut into the hold down strap 230, pushing the material of the first portion 232 apart to penetrate the edge of the first portion. The penetrated material of the first portion 232 forms around the teeth 248 so than a secure interconnection is achieved. After the nail plate 218*a* is fully driven into the lower chord 214 and block 216*a*, the teeth 248 are substantially parallel to the plane of the first portion 232 of the hold down strap 230.

Figure 7:
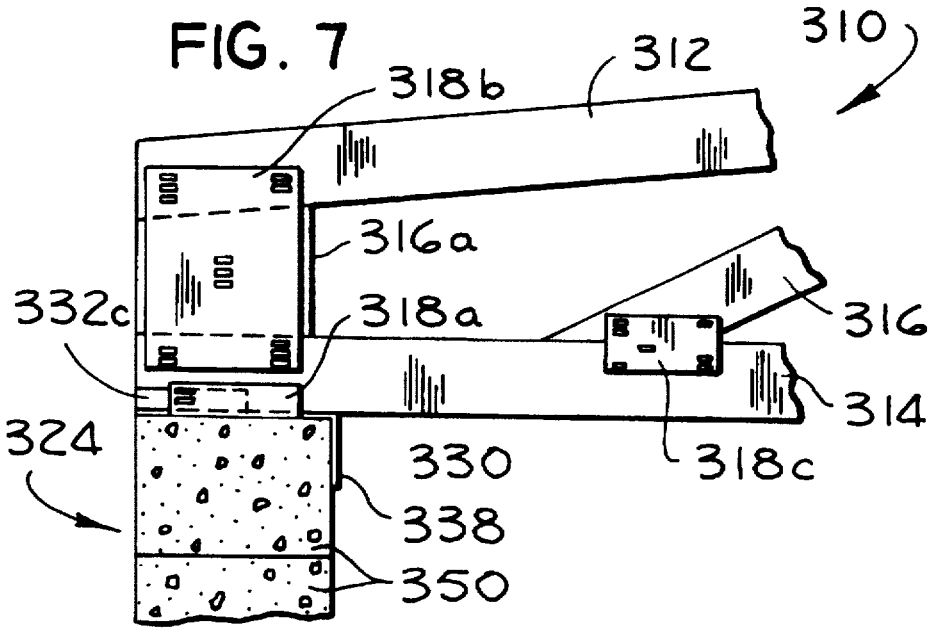
FIG. 7 is a fragmentary elevation of a truss having an integral hold down strap of a third embodiment used as a spacer between the truss and a wall formed of concrete blocks.

A strap 330 of a third embodiment is shown in FIG. 7 as used to space a truss 310 from a wall 324 made of concrete blocks 350. The strap 330 differs from the strap 30 of the first embodiment only in that its flanges 332*b*, 332*c* (only 332*c* one is shown) are bent upward instead of downward so that the strap 330 may be attached to the bottom of a lower chord 314 of the truss 310. A nailing plate 318*a* is dedicated to the securement of the strap 330 to the truss 310. Another nailing plate 318*b* secures upper and lower chords 312, 314 of the truss with a block 316*a* (i.e., web member) at the heel of the truss 310. Still another nailing plate 318*c* secures one end of a web member 316 to the lower chord 314. Although strap 330 has a second portion 338 which extends down in face-to-face engagement with and is secured to the concrete block 350, such second portion is not necessary for the strap to serve its spacing function. The strap 330 serves as a moisture barrier to prevent moisture, which is sometimes present in the block 350, from being drawn (as by a wicking action) up into the wooden truss 310 where the moisture could cause the truss to rot.

Figure 8:
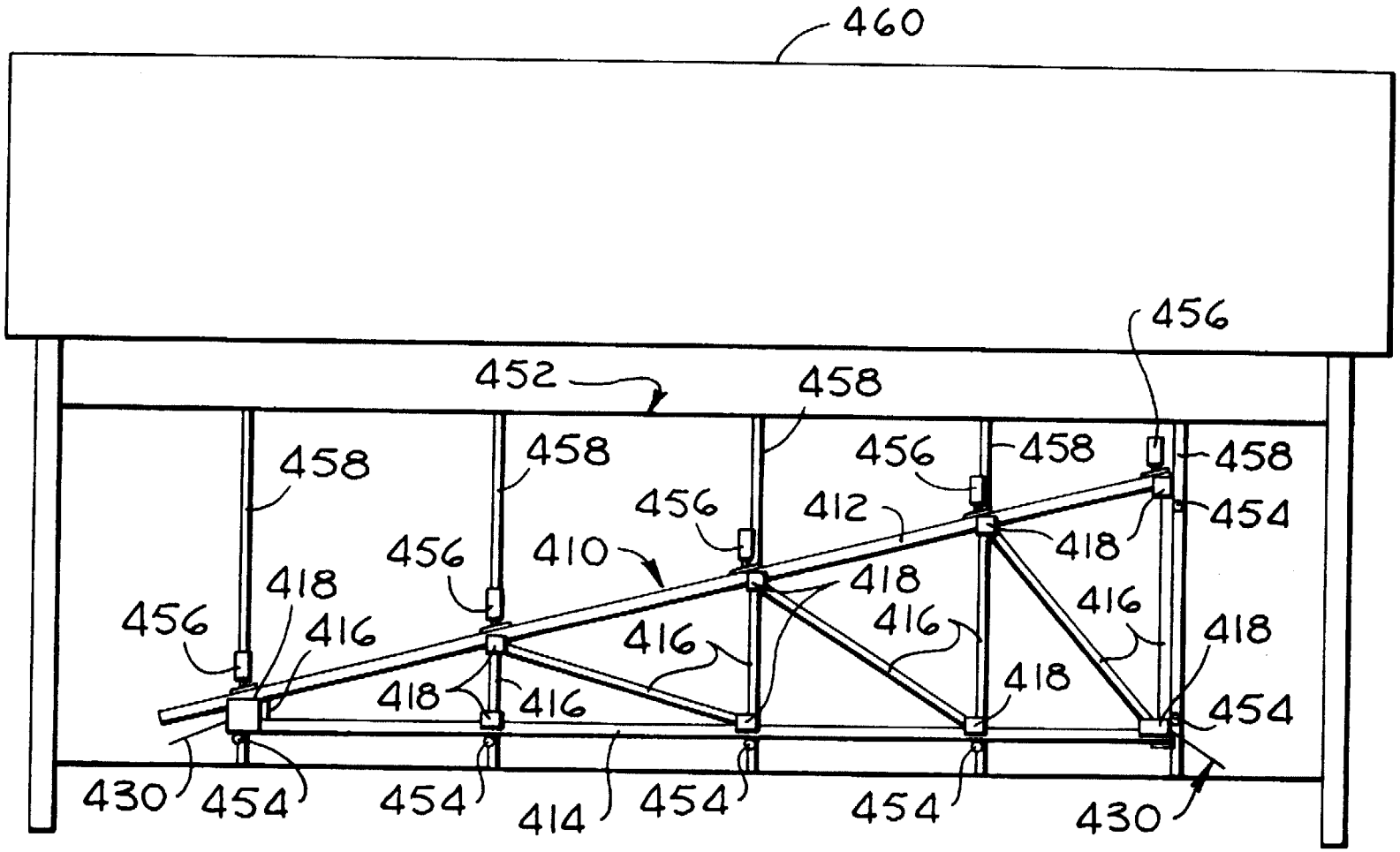
FIG. 8 is a top plan view of a truss assembly table and press.

Having described the construction of the truss and hold down strap of the present invention, a method for assembling a mono truss 410 having hold down straps 430 will be described (FIG. 8). Truss elements (i.e., upper and lower chords 412, 414 and web members 416) are placed on a truss assembly table generally indicated at 452 in a manner which is well know to those of ordinary skill in the art. The truss assembly table 452 includes stops 454 and hydraulic clamps 456 movable in transverse slots 458 in the table for jigging the truss elements in a pre-selected truss configuration, and an associated press 460 into which the table may move. The press 460 is capable of driving nailing plates 418 into the truss elements to connect them together.

As the truss elements are placed on the table 452, hold down straps 430 are placed between converging truss elements at the ends of the truss 410. Nailing plates 418 are placed underneath and on top of the truss 410, overlying at least two truss elements for securing those elements together. Four of the nailing plates 418 (i.e., those in the lower left and right hand corners of the truss 410 shown in FIG. 8, and the nailing plates directly underneath them) have teeth (not shown) which are in registration with the flanges (not shown) of the hold down straps 430. The assembly table 452 is activated to slide into the press 460 and the press drives the nailing plates 418 into the truss elements. At the same time, the press 460 drives the nailing plate teeth through the flanges (not shown) of the nailing plates 430 and into the lower chord 414, in the same way shown in FIG. 2. Thus, the hold down straps 430 are integrated with the truss 410 at the same time the conventional connections between truss elements are being formed.

The method is substantially the same when the hold down strap 230 of the second embodiment (FIG. 6) is employed. However, when the nailing plate 218*a* is placed on the upper chord 212, lower chord 214 and block 216*a*, a row of teeth 248 in the nailing plate is positioned in registration with the thin edge of the hold down strap 230 lying in the joint between the lower chord and block. Thus, when the press moves over the nailing plate 218*a*, the row of teeth 248 is driven edge on into the first portion 232 of the hold down strap between the lower chord 214 and the block 216*a*. The lower chord 214 and block 216*a* are jigged so that they will not separate as the low of teeth 248 is driven into the edge of the hold down strap 230 between the lower chord and block.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A primary structural component such as a truss for use with other structural components to form a structure, the primary structural component comprising:

a first member including a first surface and a second surface non-coplanar with the first surface;

a second member of thin, flat sheet material engaging the first surface of said first member in face-to-face relation;

a nailing plate having teeth penetrating the second surface of said first member and teeth penetrating the second member thereby to secure the second member to the first member.

2. A primary structural component as set forth in claim 1 wherein the teeth of the nailing plate extend generally perpendicularly outwardly from the nailing plate in a direction generally parallel to the first surface of said first member.

3. A primary structural component as set forth in claim 2 in combination with one of said other structural components, the second member lying between the first member and said one other structural component thereby to space the first member from said one other structural component.

4. A primary structural component as set forth in claim 2 wherein the second member comprises a hold down strap including a first portion engaging said first member and a second portion sized to extend from the first portion and into engagement with one of said other structural components for connection to said one other structural component thereby to secure the primary structural component to said one other structural component.

5. A primary structural component as set forth in claim 4 wherein the first portion of the hold down strap has a flange engaging the second surface of the first member in face-to-face relation, at least some of the teeth of the nailing plate passing through the flange and second surface into the first member.

6. A primary structural component as set forth in claim 4 wherein the first portion comprises a pair of flanges, a first of the flanges being in face-to-face engagement with the second surface of the first member and a second of the flanges being in face-to-face engagement with a third surface of the first member, at least some of the teeth of the nailing plate passing through the first flange and second surface into the first member, the primary structural component further comprising another nailing plate having teeth passing through the second flange and third surface into the first member.

7. A primary structural component as set forth in claim 6 wherein the hold down strap is made of sheet metal of a first gauge and the nailing plates are made of sheet metal of a second gauge thicker than the first gauge.

8. A primary structural component as set forth in claim 7 wherein the sheet metal of the first hold down strap is approximately 26 gauge.

9. A primary structural component as set forth in claim 1 wherein the hold down strap is free of connection to the first member except by the nailing plate.

10. A primary structural component as set forth in claim 4 further comprising a third member having a first surface, at least a portion of the second member being sandwiched between the first surfaces of said first and third members, and wherein the nailing plate has teeth penetrating the third member thereby to connect the third member to the first member.

11. A hold down strap for securing a truss formed by elongate truss elements to a wall of a structure, the hold down strap comprising an elongate piece of sheet metal, the sheet metal being smooth, flat and free of teeth and fastener openings formed therein, the hold down strap including a first portion and a second portion, the first portion having a central region and a pair of flanges on either side of the central region, the central region having a transverse dimension approximately equal to a transverse dimension of at least one of the truss elements, the flanges being foldable along longitudinal edges of the central portion to configure the first portion of the hold down strap to have a generally U-shaped cross section, the first portion thus folded being constructed to receive a portion of the truss element therein, the folded flanges being engageable with said one truss element and constructed for penetration by teeth of a nailing plate to secure the hold down strap to the truss element, the second portion of the hold down strap being sized to extend down from the truss into engagement with a wall of the structure and to receive a connector therethrough for securing the truss to the wall.

12. A hold down strap as set forth in claim 11 wherein the hold down strap is formed as one piece of sheet metal having a gauge which is less than the gauge of the metal of the nailing plate needed for teeth of the nailing plate to penetrate the truss element.

13. A hold down strap as set forth in claim 12 wherein the elongate piece of sheet metal is 26 gauge sheet metal.

14. A method for forming a truss with integral hold down straps for connection to a wall of a structure, the truss having opposite ends, the method comprising the steps of:

placing elongate truss elements in a truss assembly jig;

positioning thin, flat hold down straps having longitudinal edges between converging truss elements at the ends of the truss;

placing nailing plates on at least one of the truss elements generally at opposite ends of the truss, each nailing plate having teeth in registration with at least one of the truss elements at the corresponding end of the truss and teeth in registration with the hold down strap;

driving the nailing plates into the truss so that teeth from each nailing plate penetrate the hold down strap and penetrate said one truss element thereby to connect the hold down strap to the truss.

15. A method as set forth in claim 14 wherein the step of driving the nailing plate into the truss includes the step of penetrating with the teeth of each nailing plate at least one other truss element for interconnecting said one other truss element with said one truss element.

16. A method as set forth in claim 14 wherein the step of driving the nailing plates into the truss includes the step of penetrating the hold down strap with the teeth of each nailing plate extending into the longitudinal edges of the corresponding hold down strap between the converging truss elements at the end of the truss.

17. A truss formed with an integral hold down strap for securing the truss to a wall of a structure, the truss comprising:

truss elements comprising chords including an upper chord and lower chord, and web members spanning between the lower chord and the upper chord;

nailing plates having teeth embedded in the truss, at least some of the nailing plates being located at joints between web members and chords for connecting the web members to the chords;

flexible hold down straps located generally at opposite ends of the truss and extending from the truss for connection to the structure wall, each hold down strap comprising an elongate piece of sheet material and including a first portion sandwiched between truss elements at a joint generally at an end of the truss and a second portion sized to extend from between said truss elements into engagement with the wall of the structure, the teeth of one of the nailing plates penetrating the hold down strap and at least one of the truss elements thereby to secure the hold down strap to the truss.

18. A truss as see forth in claim 17 wherein the teeth of the nailing plate extend generally perpendicularly outwardly from the nailing plate in a direction generally parallel to the first portion of the hold down strap between the truss elements at said joint.

19. A truss as set forth in claim 17 wherein the first portion of the hold down strap has a flange engaging one of the truss elements at the joint in face-to-face relation outside of said joint, at least some of the teeth of the nailing plate passing through the flange into the truss element.

20. A truss as set forth in claim 17 wherein the hold down strap is made of sheet metal of a first gauge and the nailing plates are made of sheet metal of a second gauge thicker than the first gauge.

21. A truss as set forth in claim 20 wherein the sheet metal of the first hold down strap is approximately 26 gauge.

22. A truss as set forth in claim 17 wherein the hold down straps are free of connection to the first member except by the nailing plates.

* * * * *